US006834683B2

(12) United States Patent
Birner et al.

(10) Patent No.: US 6,834,683 B2
(45) Date of Patent: Dec. 28, 2004

(54) METHOD AND APPARATUS FOR MONITORING A LEADING END OF A WEFT THREAD IN A STRETCHING CHANNEL IN AN AIR JET LOOM

(75) Inventors: Werner Birner, Lindau (DE); Herbert Reinhardt, Achberg (DE); Christian Hannes, Wangen (DE); Alexander Chvorak, Lindau (DE); Peter D. Dornier, Lindau (DE)

(73) Assignee: Lindauer Dornier Gesellschaft mbH, Lindau (DE)

( * ) Notice: Subject to any disclaimer, the term of this patent is extended or adjusted under 35 U.S.C. 154(b) by 219 days.

(21) Appl. No.: 10/144,449

(22) Filed: May 10, 2002

(65) Prior Publication Data

US 2003/0000594 A1 Jan. 2, 2003

(30) Foreign Application Priority Data

Jun. 8, 2001 (DE) ..... 101 15 172

(51) Int. Cl.[7] ..... D03D 51/36
(52) U.S. Cl. ..... 139/370.2
(58) Field of Search ..... 139/194, 370.2, 139/372, 377, 435.1

(56) References Cited

U.S. PATENT DOCUMENTS 4,527,598 A 7/1985 Walch
4,962,794 A * 10/1990 White ..... 139/370.2
5,606,998 A 3/1997 Wahhoud et al.
5,735,316 A 4/1998 Hehle
6,076,563 A * 6/2000 Wahhoud et al. ..... 139/194
6,082,413 A 7/2000 Scorl et al.

FOREIGN PATENT DOCUMENTS

| | | |
|---|---|---|
| DE | 4443371 | 1/1996 |
| DE | 19545839 | 8/1996 |
| DE | 19802254 | 8/1999 |
| EP | 0493847 | 7/1992 |
| EP | 0645485 | 3/1995 |

* cited by examiner

*Primary Examiner*—Danny Worrell
(74) *Attorney, Agent, or Firm*—W. F. Fasse; W. G. Fasse

(57) ABSTRACT

The leading end of a weft thread exiting from a weft insertion channel in an air jet weaving loom is monitored by a weft stop motion positioned in a weft stretching channel directly downstream, as viewed in the weft motion direction, of an exit of the weft insertion channel. The weft stop motion is either an additional weft stop motion monitor or it is the first weft stop motion device repositioned from a location at the exit of the weft insertion channel to a location in the weft stretching channel. In such a position in the weft stretching channel faults or deformations such as a loop in the leading end section of the weft thread are readily or positively detected for generating a respective loom control signal.

18 Claims, 5 Drawing Sheets

METHOD AND APPARATUS FOR MONITORING A LEADING END OF A WEFT THREAD IN A STRETCHING CHANNEL IN AN AIR JET LOOM

This application is based on and claims the priority under 35 U.S.C. §119 of German Patent Application 101 15 172.1, filed on Jun. 8, 2001, the entire disclosure of which is incorporated herein by reference.

FIELD OF THE INVENTION

The invention relates generally to air jet weaving looms and particularly to the monitoring of the weft insertion in an air jet weaving loom, particularly downstream of the exit of the weft insertion channel.

BACKGROUND INFORMATION

German Patent Publication DE 44 43 371 C1 corresponding to U.S. Pat. No. 5,606,998 (Wahhoud et al.) discloses a weft thread stretching mechanism and a weft thread detection or monitoring device for jet weaving looms. The main purpose of the disclosure of U.S. Pat. No. 5,606,998 is to avoid identifying a temporary excess length of the leading end section of a weft thread that occurs due to stretching of the weft thread, as a weft thread break. More specifically, the temporary excessive weft thread length at the leading end section of the weft thread shall not lead to stopping the weaving loom. The excess length is temporarily caused by exposing the leading end of the weft to a stretching operation by a stretching jet that is effective to blow the leading end of the weft thread in a direction perpendicularly to the feed advance direction defined by the longitudinal axis of the weft insertion channel. The stretching jet blows the leading end of the weft through a stretching channel extending in a plane laterally displaced from the plane defined by the feed advance direction. For this purpose, the monitors or so-called weft stop motion devices are arranged at the end of the stretching channel or path. Additionally, the axial length of the stretching channel is adjustable. In order to accommodate this adjustable length of the stretching channel, the position of the weft stop motion devices at the end of the stretching channel is also adjustable in the axial direction of the main weft insertion channel of the loom. Such a structure avoids identifying a temporary excess length that occurs due to the stretching of the weft thread as a weft break. As a result, the loom operation is not erroneously shut down. Only when the leading end of the weft does not pass all the way through the stretching channel will the loom stopping signal be generated.

German Patent Publication DE 195 45 839 C1, corresponding to U.S. Pat. No. 5,735,316 (Hehle) relates to a method and apparatus in an air jet weaving loom for avoiding the formation of a so-called catch selvage. Instead, a leading end of the inserted weft thread is stretched by a special deflecting weft stretching jet nozzle and the deflected end is cut off and withdrawn by suction. A first weft stop motion device is positioned at the exit of the weft insertion channel upstream of the stretching nozzle. A second weft stop motion device is positioned downstream of the stretching channel.

German Patent Publication DE 198 02 254 C1 corresponding to U.S. Pat. No. 6,082,413 (Scorl et al.) relates to a weft thread stretching and detecting mechanism for air jet weaving looms in which again the leading end of the weft thread is deflected by a stretching nozzle into a separate stretching channel that extends in a plane different from the plane defined by the longitudinal axis of the weft thread insertion channel. A first weft stop motion device is arranged upstream of the catch selvage and upstream of the deflecting stretching nozzle. A single second weft stop motion device is arranged at the exit end of the stretching channel and at the end of the extension of the weft insertion channel. A beam transmitter and a beam sensor are so arranged relative to each other at the exit ends of the stretching channel and of the insertion channel so that the beam must cross the exits of both channels. This position of the weft stop motion device can monitor both the insertion channel and the stretching channel in order to ascertain whether an excessively long weft thread or a broken weft thread is involved.

European Patent Publications EP 0,493,847 A1 (Bamelis) and EP 0,645,485 A1 (Granelli et al.) disclose different types of stretching channels. In both instances the weft stop motion device is arranged upstream of the stretching channel at the exit of the insertion channel.

In all known devices with a stretching channel that is either aligned with the insertion channel or is positioned in a different plane from the plane of the insertion channel, it is not excluded that a leading end section of the weft thread is deformed, for example by the formation of a loop or kink. The positioning of the weft stop motion devices according to the prior art does not enable these devices to ascertain whether a leading end section of a weft thread has been deformed. If a weft thread with a loop or a kink in its leading end section is beat-up into the fabric, the resulting fabric does not meet the required quality.

OBJECTS OF THE INVENTION

In view of the foregoing it is the aim of the invention to achieve the following objects singly or in combination:

- avoid weaving a weft thread deformation, particularly a loop or a kink at the leading end section of a weft thread into the fabric;
- to position either an additional weft stop motion device or the so-called first weft stop motion device in a location where the weft thread deformation, particularly at the leading end of the weft thread can be positively discovered for producing a control signal that will cause a corrective action in the loom operation; and
- to generate a loom stop signal in response to the absence of the leading end of the weft thread in the stretching channel and to evaluate the presence of the leading end of the weft threads in the stretching channel as a weft thread that has not been deformed.

SUMMARY OF THE INVENTION

The above objects have been achieved according to the invention in a method for detecting a deformation such as a loop or a kink in a leading end section of a weft thread exiting from a weft insertion channel in an air jet weaving loom by performing the following steps:

(a) positioning an additional weft stop motion device (10) in an entrance area of a weft stretching path, (b) exposing said leading end section of said weft thread to a stretching force in said weft stretching path downstream of said weft insertion channel, (c) monitoring with said additional weft stop motion device (10) a presence or absence of a leading end (7B) of said leading end section (7A) of said weft thread (7) in said entrance area of said weft stretching path downstream of said waft insertion channel, and (d) generating a loom control signal in response to said presence or absence of said leading end (7B) in said entrance area of said weft stretching path.

Positioning the weft stop motion device in an entrance area of the weft stretching path allows monitoring the arrival and any deformation of the leading end section of a weft thread.

The method according to the invention is performed by an apparatus that comprises a weft stretching channel positioned downstream of the weft insertion channel. The weft stretching channel has an entrance area where a jet nozzle is positioned for seizing the leading end section of the weft thread and driving the weft thread into the entrance area of the weft stretching channel and then through the weft stretching channel. According to the invention, a weft stop motion device is positioned in the weft stretching channel or rather in a position for monitoring the passage of the leading weft thread end through the stretching channel to thereby ascertain the presence or absence of the leading end section of the weft thread in the weft stretching channel.

The weft stretching channel may be positioned in axial alignment with the longitudinal axis of the weft insertion channel or it may be positioned in a plane other than a plane defined by the longitudinal axis of the weft insertion channel. In both instances the weft stop motion device will be positioned to monitor the presence or absence of the leading end section of the weft thread in the stretching channel.

It is customary to refer to the weft stop motion device that is positioned at the exit end of the weft insertion channel as the first weft stop motion, while the weft stop motion device at the exit end of the stretching channel is referred to as the second weft stop motion. It has been found that the positioning of a weft stop motion device at the exit end of the weft insertion channel merely determines the arrival of a leading weft thread end at the exit. In such a position at the exit of the weft insertion channel the weft stop motion device cannot determine whether or not there is a deformation in the end section of the leading weft thread end that has come out of the exit of the weft insertion channel. In order to detect a weft end deformation it is critical to position at least one weft stop motion device in a location for monitoring the stretching of the weft leading end section in the stretching channel or path to thereby determine the presence or absence of the leading end section of the weft thread in the stretching channel. Thus, in an apparatus according to the invention either an additional weft stop motion device is positioned relative to the stretching path or channel or the so-called first weft stop motion device is placed further downstream for monitoring the weft thread end in the weft stretching path or channel. In that case, the so-called "first" weft stop motion directly at the exit of the weft insertion channel is not used at all. Thus, if the leading end section does not appear in the stretching channel or path or is too short because of a loop upstream of the stretching channel, a loom stop signal is generated.

It has been further found, that the formation of a deformation such as a loop or kink in the leading end section of the weft thread happens particularly when the weft thread is deflected by a stretching jet out of the plane of the weft insertion channel into another plane in which the stretching channel is located. The blowing of the leading weft end into the stretching path or channel results in a temporary lengthening which is detected by positioning the weft stop motion as taught by the invention relative to the weft stretching path or channel and not necessarily at the exit end of the weft insertion channel. Thus, a single weft stop motion device placed for monitoring the stretching path or channel can detect the predetermined length that results from the stretching and a possible loop signifying that the leading weft thread end section does not have the proper "length" due to the loop formation. In that case, the leading end does not reach the weft stop motion device in the stretching channel and the further loom operation is stopped. No stopping of the loom occurs when the leading end of the weft thread reaches the conventional "first" weft stop motion device if no break in the weft thread has occurred.

By placing or locating the weft stop motion device for monitoring the stretching channel, the so placed weft stop motion performs the function of the so-called first weft stop motion device and of an additional weft stop motion device that detects not only the arrival of the leading end, but also whether or not a loop has been formed in the leading end section of the weft.

BRIEF DESCRIPTION OF THE DRAWINGS

In order that the invention may be clearly understood, it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
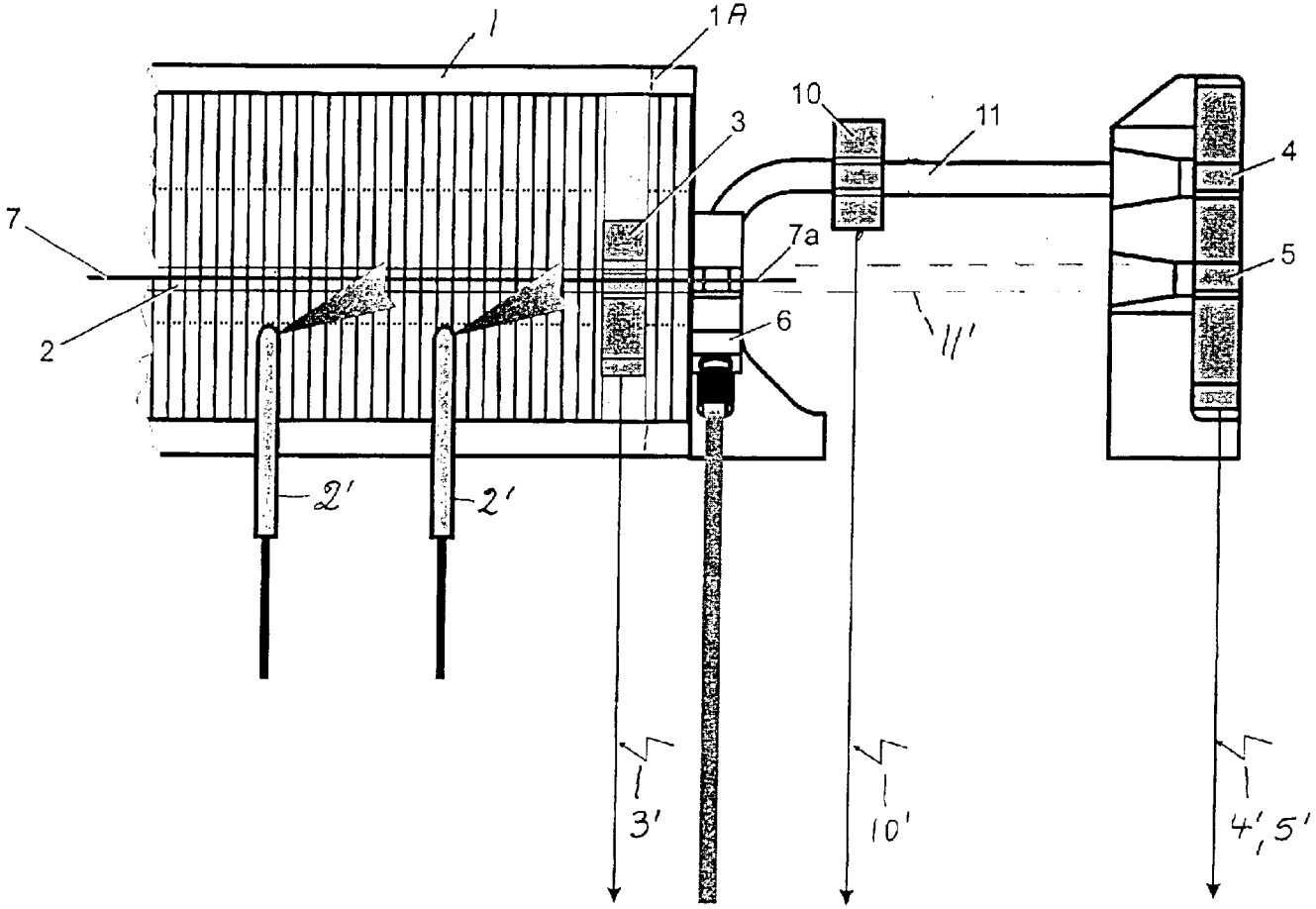
FIG. 1 is a schematic side view of the weft exit end of a weft insertion channel in an air jet weaving loom equipped with an additional weft stop motion device for monitoring the weft stretching channel.

FIG. 1 shows the exit end of a reed 1 of an air jet weaving loom. A weft insertion channel 2 is equipped with a first weft stop motion device 3 that monitors the arrival of the leading end 7A of a weft thread 7 that has passed through the weft insertion channel 2 by conventional air jets 2'. The first weft stop motion device 3 is positioned at the exit end of the weft insertion channel 2 between the reed 1 and an auxiliary reed 1A. The weft stop motion device 3 provides a signal 3' to the loom control, not shown, that the leading end 7A has properly arrived or not arrived.

A weft stretching channel 11 is positioned along an axis parallel to the plane defined by the longitudinal axis of the weft insertion channel 2. An open air path 11' forms an extension of the insertion channel 2. Two conventional weft stop motion devices 4 and 5 are positioned at the exit end of the weft stretching channel 11 and path 11'. The weft thread passes through the channel 11 when it is deflected by the stretching nozzle 6 or it passes through the path 11' when the weft thread is not stretched or it is stretched by another nozzle arrangement not shown.

FIG. 1 shows the position of the first weft stop motion device 3 at the exit end of the weft insertion channel 2 and the second weft stop motion device or devices 4 and 5 at the exit end of the stretching channel 11 or path 11'. The additional weft stop motion device 10 according to the invention is positioned in the weft stretching channel 11, preferably as close to its entrance as possible. Three different signals 3', 10' and 4' or 5' are provided in the arrangement of FIG. 1. The signals are supplied to the central loom control for evaluation and production of a loom stopping signal if a loop or kink has been formed in the leading end section of the weft thread or if a break in the weft thread has been discovered.

Figure 2:
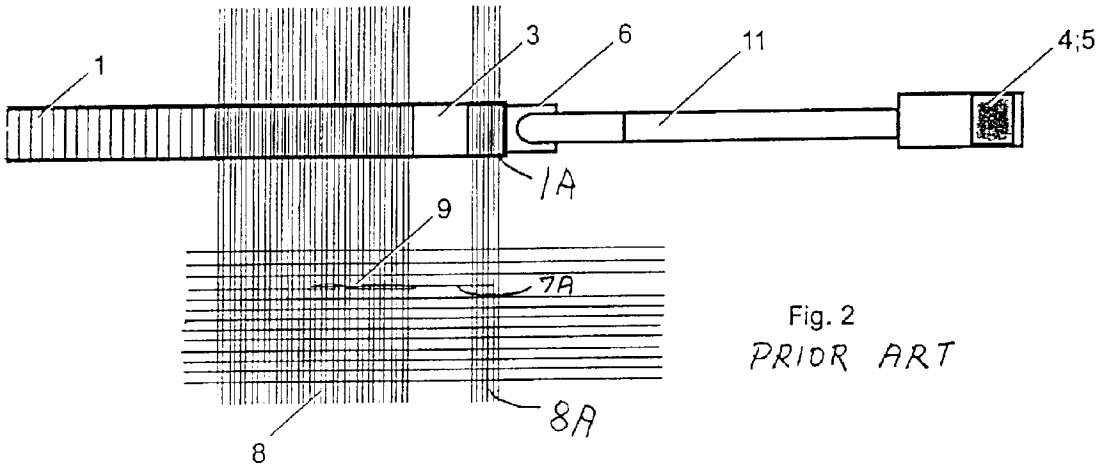
Fig. 2 PRIOR ART
FIG. 2 illustrates the conventional positioning of the first and second weft stop motion devices.

FIG. 2 illustrates the conventional arrangement of the first weft stop motion device 3 at the exit end of the weft insertion channel 1 between the fabric 8 formed by the reed 1 and the auxiliary or catch selvage 8A formed by the auxiliary reed 1A. The second weft stop motion device 4 and/or 5 is positioned at the end of the weft stretching channel 11. It has been found that due to the position of the first weft stop motion device 3, the device 3 cannot properly detect the presence of a deformation such as a loop 9 in a weft thread because the leading end 7A of the weft thread 7 may still reach the weft stop motion device. The invention has solved this problem by either providing an additional weft stop motion device 10 for monitoring the weft thread in the stretching channel or by repositioning the so-called first weft stop motion device 3.

Figure 3:
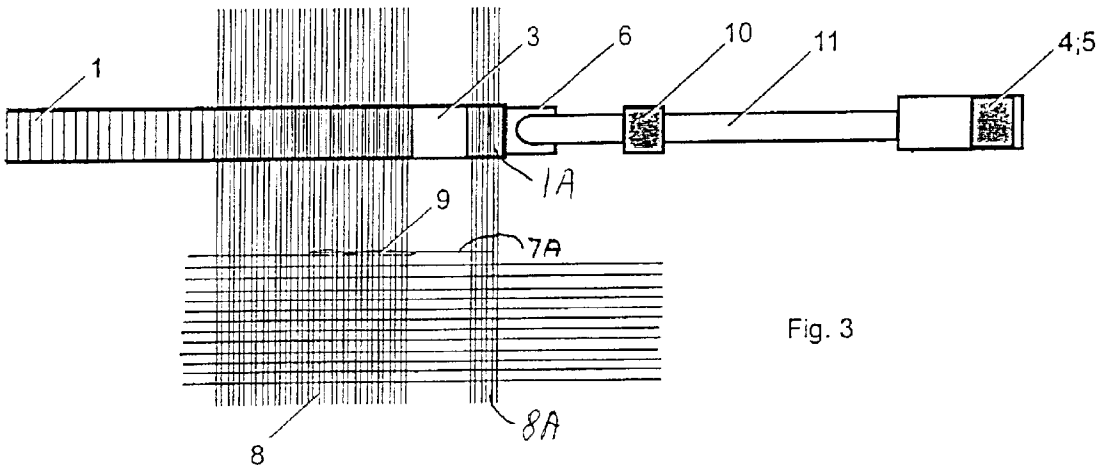
FIG. 3 illustrates one embodiment of the positioning of the weft stop motion device according to the invention.

FIG. 3 illustrates the use of three or four weft stop motion devices, namely a further weft stop motion device 10 according to the invention in addition to the first and second weft stop motion devices 3 and 4 or 5.

Figure 4:
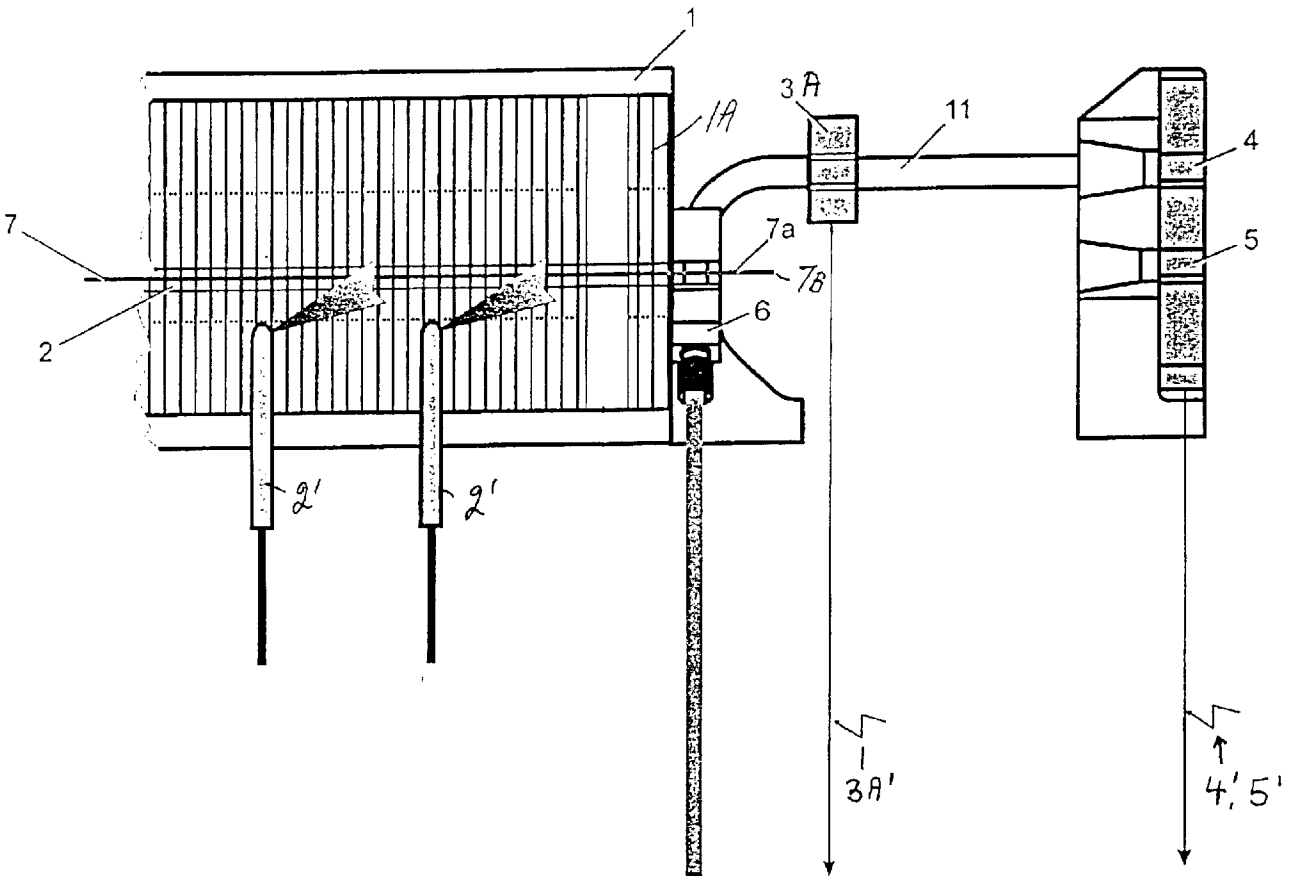
FIG. 4 is a side view similar to that of FIG. 1 illustrating the positioning of the so-called "first" weft stop motion device in a position according to the invention while omitting the conventional "first" weft stop motion device at the weft insertion channel exit.

FIG. 4 illustrates the repositioning of the first weft stop motion device 3 into the position 3A according to the invention for monitoring the leading weft end in the weft stretching channel 11 that is located along an axis parallel to an axis defined by an extension of the length axis of the weft insertion channel 2. Two weft stop motion signals 3A' and 4' or 5' are provided and processed by the main loom control not shown. In the position 3A the respective weft stop motion device can now detect the formation of a kink or loop 9 in the weft thread 7 because the leading end 7B does not reach the weft stop motion device 3A in its position according to the invention.

Figure 5:
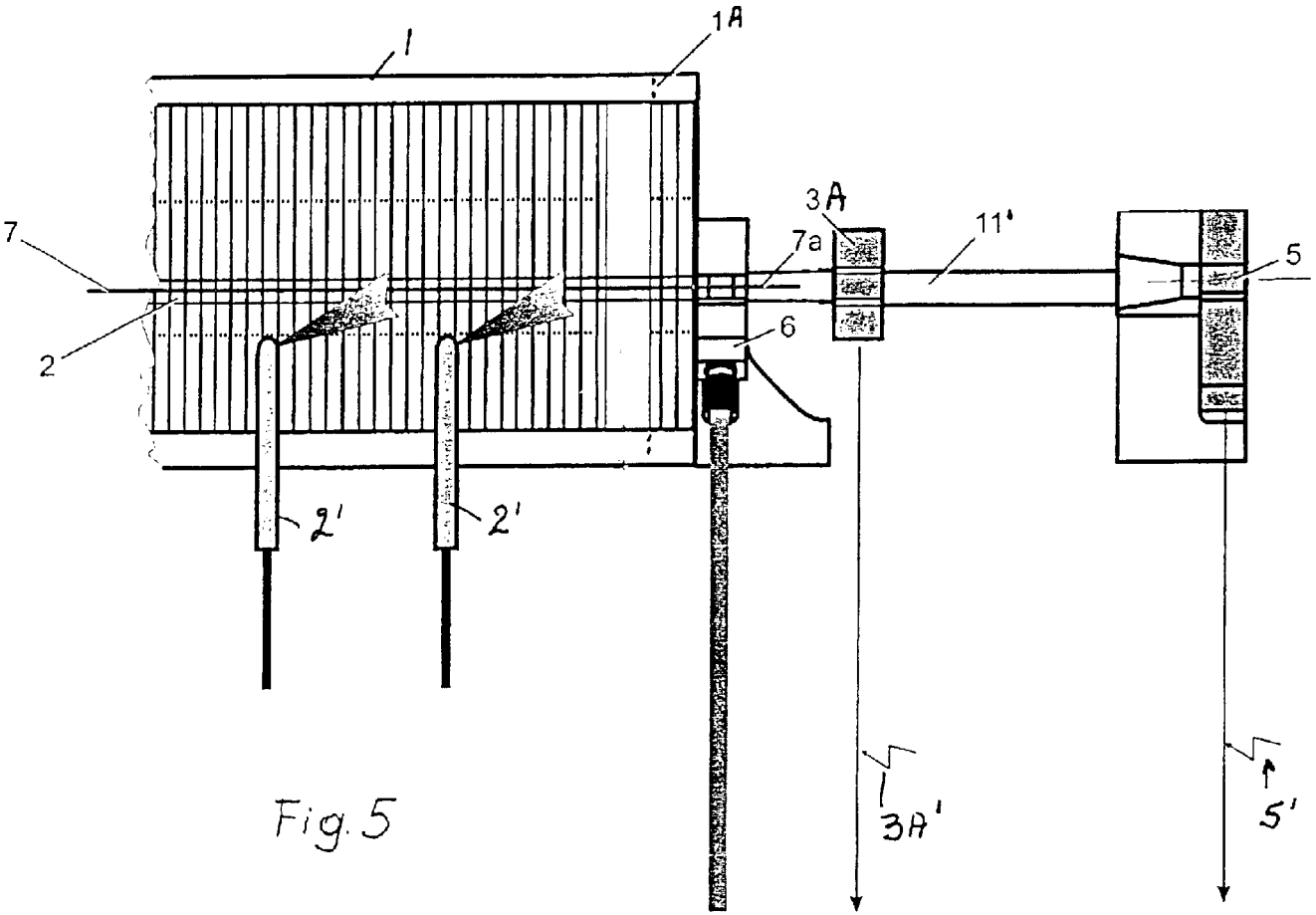
FIG. 5 is a view similar to that of FIGS. 1 and 4, however, illustrating the position of a weft stretching path in axial alignment with the weft insertion channel and with the "first" weft stop motion device positioned according to the invention relative to the weft stretching path.

FIG. 5 illustrates the positioning of the weft stop motion device 3A according to the invention downstream of the stretching nozzle 6 rather than next to the exit of the weft insertion channel 2 between the reed 1 and the auxiliary reed 1A. The path 11' may be an open air channel which is axially aligned with the length axis of the weft insertion channel 2. Here again the signal 3A' is produced when the leading end 7A of the weft thread 7 does not reach the weft stop motion device 3A due to a loop or kink 9 or due to another deformation in a leading end section 7B of the weft thread 7.

Figure 6:
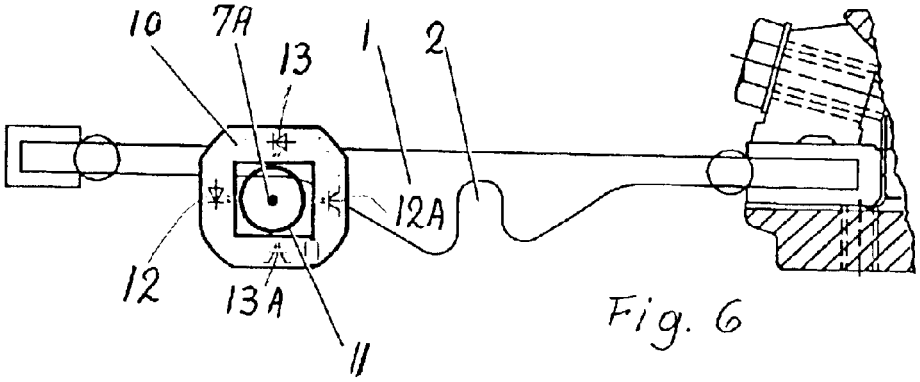
FIG. 6 illustrates a weft stop motion device according to the invention.

FIG. 6 illustrates a weft stop motion device 10 according to the invention which is constructed to completely surround the weft stretching channel 11 through which the weft thread with its leading end 7A is traveling when the weft thread is stretched. The reed 1 also shows the weft insertion channel 2. In FIG. 6 the weft stretching channel 11 is laterally displaced relative to the weft insertion channel 2.

Figure 7:
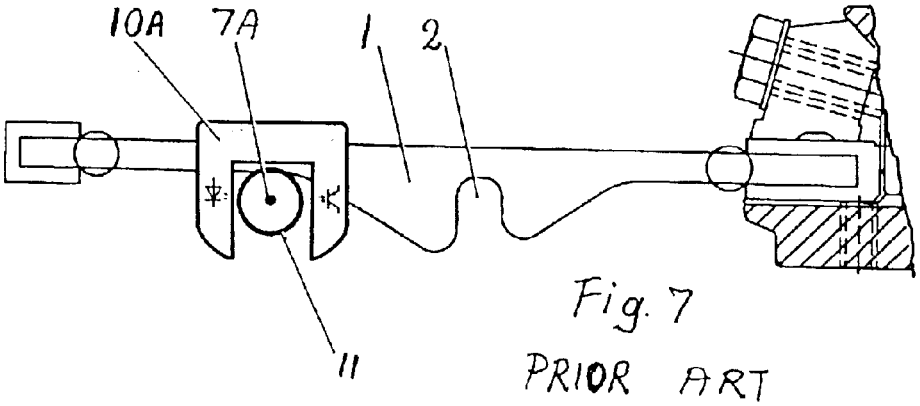
Fig. 7 PRIOR ART
FIG. 7 illustrates a conventional weft stop motion device.

The weft stop motion device 10 according to the invention comprises two detection paths which cross each other. For this purpose a radiation generator 12, such a light emitting diode, cooperates with a sensor 12A such as a light sensitive diode. The generator 12 and the sensor 12A are arranged diagonally opposite each other. Similarly, a radiation or beam generator 13 is arranged diagonally opposite a sensor 13A. As a result, the two radiation generators 12 and 13 and the two sensors 12A and 13A are distributed and angularly spaced in a ring structure that completely surrounds the weft stretching channel 11. As shown, the angular spacing is 90°. A more precise detection is achieved with this arrangement of the generators and sensors. More than two pairs of generators and sensors could be used in a common housing. Additionally, the weft stop motion device 10 according to the invention has the advantage that contamination of the interior of the device 10 is substantially reduced because flying dust and the like cannot laterally enter the weft stop motion device 10 as is possible by the conventional sensor 10A that has a laterally open U-configuration as shown in FIG. 7.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A weft stop motion monitor for weaving looms, said monitor comprising a ring-shaped housing for surrounding a weft motion path, at least two radiation generators arranged in said housing, at least two radiation sensors arranged in said housing, said at least two radiation sensors and said at least two radiation generators forming two pairs, each pair including a generator and a sensor positioned diagonally opposite each other so that a weft thread passing through said monitor is observed from at least two different sides.

2. The weft stop motion monitor of claim 1, wherein said angular spacing between said at least two radiation generators and between said at least two radiation sensors is 90°.

3. The weft stop motion monitor of claim 1, wherein each of said at least two radiation generators produces a radiation beam to be sensed by a respective sensor.

4. The weft stop motion monitor of claim 1, wherein said at least two radiation generators are light emitting diodes and wherein said at least two radiation seniors are light sensitive diodes.

5. A method for detecting a deformation in a leading end section of a weft thread exiting from a weft insertion channel in an air jet weaving loom including at least one waft atop motion device, said method comprising the following steps:

(a) positioning an additional weft stop motion device (10) in an entrance area of a weft stretching path, (b) exposing said leading end section of said waft thread to a stretching force in said weft stretching path downstream of said weft insertion channel, (c) monitoring with said additional weft stop motion device (10) a presence or absence of a leading end (7B) of said leading end section (7A) of said waft thread (7) in said entrance area of said weft stretching path downstream of said weft insertion channel, and (d) generating a loom control signal in response to said presence or absence of said leading end (7B) in said entrance area of said weft stretching path.

6. The method of claim 5, further comprising positioning said at least one weft stop motion device (4) at an exit of said waft stretching path, and avoiding positioning any weft stop motion device at an exit end of said waft insertion channel.

7. The method of claim 5, wherein said loom control signal produced by said additional weft stop motion device (10) is a continue weaving signal in response to the presence of said leading weft end in said entrance area of said weft stretching path.

8. The method of claim 5, wherein said loom control signal produced by said additional weft stop motion device (10) is a stop motion signal in response to the absence of said leading weft end in said entrance area of said weft stretching path.

9. The method of claim 8, further comprising using said stop motion signal for starting an automatic weft fault removal.

10. An apparatus for detecting a deformation in a leading end section of a waft thread exiting from a weft insertion channel in an air jet weaving loom, said apparatus comprising a weft stretching channel positioned downstream of said weft insertion channel, said weft stretching channel including a weft entrance area, a jet nozzle positioned for seizing said leading end section of said weft thread and driving said weft thread into said weft entrance area and through said weft stretching channel, at least two weft stop motion devices positioned for monitoring said leading end section of said waft thread, wherein one weft stop motion device (3A) of said at least two weft stop motion devices is positioned in an entrance area of said weft stretching channel for monitoring the presence or absence of said leading end section of said weft thread in said weft entrance area of said weft stretching channel, and wherein the other weft stop motion device (4) of said at least two weft stop motion devices is positioned at an exit of said weft stretching channel.

11. The apparatus of claim 10, wherein said one weft stop motion device (3A) positioned in an entrance area of said weft stretching channel monitors an exit of said weft insertion channel and said entrance area of said weft stretching channel.

12. The apparatus of claim 10, wherein said weft insertion channel and said weft stretching channel are positioned in axial alignment with each other.

13. The apparatus of claim 10, wherein said weft insertion channel and said weft stretching channel are displaced relative to each other so that axes of said weft insertion channel and of said weft stretching channel extend in different planes next to each other.

14. The apparatus of claim 10, comprising a further weft stop motion device (3) positioned at an exit of said weft insertion channel and wherein said one weft stop motion device (10) and said further weft atop motion device are adjustable in their position relative to each other.

15. The apparatus of claim 10, wherein said one weft atop motion device (10) is adjustable in its position in said waft stretching channel.

16. An air jet weaving loom comprising a weft insertion channel, a weft stretching channel positioned for cooperation with said weft insertion channel, a weft stop motion device (10) positioned in said weft stretching channel, a further weft stop motion device (4) at an exit of said waft stretching channel, and wherein said weft stop motion device (10) is adjustable in its position relative to said further weft stop motion device (4).

17. The air jet weaving loom of claim 16, wherein said waft stop motion device (10) positioned in said weft stretching channel is positioned between an exit of said waft insertion channel and said further waft stop motion device (4) at an exit of said waft stretching channel.

18. The air jet weaving loom of claim 16, wherein said waft stop motion device positioned in said weft stretching channel is the first waft stop motion device as viewed in the feed advance direction of a weft thread.

* * * * *

UNITED STATES PATENT AND TRADEMARK OFFICE

CERTIFICATE OF CORRECTION

PATENT NO. : 6,834,683 B2
DATED : December 28, 2004
INVENTOR(S) : Birner et al.

It is certified that error appears in the above-identified patent and that said Letters Patent is hereby corrected as shown below:

Column 2,
Line 33, before “avoid”, insert -- to --;
Line 64, after “said”, replace “waft” by -- weft --;

Column 6,
Line 41, after “radiation”, replace “seniors” by -- sensors --;
Line 45, after “one”, replace “waft atop” by -- weft stop --;
Line 49, after “section of said”, replace “waft” by -- weft --;
Line 55, after “(7A) of said”, replace “waft” by -- weft --;
Line 63, before “stretching”, replace “waft” by -- weft --;
Line 64, after “said”, replace “waft” by -- weft --;

Column 7,
Line 12, after “section of a”, replace “waft” by -- weft --;
Line 21, after “said”, replace “waft” by -- weft --;

Column 8,
Lines 12 and 14, after “weft”, replace “atop” by -- stop --;
Lines 15 and 20, after “said”, replace “waft” by -- weft --;
Lines 25 and 30, before “stop”, replace “waft” by -- weft --;
Lines 26 and 28, after “said”, replace “waft” by -- weft --;
Line 27, after “further”, replace “waft” by -- weft --;
Line 31, after “first”, replace “waft” by -- weft --.

Signed and Sealed this

Sixth Day of September, 2005

JON W. DUDAS
*Director of the United States Patent and Trademark Office*